US010457043B2

(12) United States Patent
Furukawa

(10) Patent No.: US 10,457,043 B2
(45) Date of Patent: Oct. 29, 2019

(54) PIEZOELECTRIC PRINT HEAD AND PIEZOELECTRIC INK JET PRINTER

(71) Applicant: SEIKO EPSON CORPORATION, Tokyo (JP)

(72) Inventor: Ryota Furukawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/141,014

(22) Filed: Sep. 25, 2018

(65) Prior Publication Data

US 2019/0092001 A1 Mar. 28, 2019

(30) Foreign Application Priority Data

Sep. 27, 2017 (JP) ..... 2017-186450

(51) Int. Cl.
*B41J 2/045* (2006.01)
*B41J 2/14* (2006.01)

(52) U.S. Cl.
CPC ..... *B41J 2/04551* (2013.01); *B41J 2/04515* (2013.01); *B41J 2/04536* (2013.01); *B41J 2/04541* (2013.01); *B41J 2/04581* (2013.01); *B41J 2/04593* (2013.01); *B41J 2/04596* (2013.01); *B41J 2/14233* (2013.01); *B41J 2002/14241* (2013.01); *B41J 2002/14362* (2013.01); *B41J 2002/14419* (2013.01)

(58) Field of Classification Search
CPC ..... B41J 2/04551; B41J 2/04515; B41J 2/14233; B41J 2/04596; B41J 2/04593; B41J 2/04541; B41J 2/04581; B41J 2/04536; B41J 2002/14419; B41J 2002/14362; B41J 2002/14241
See application file for complete search history.

(56) References Cited

U.S. PATENT DOCUMENTS 5,500,988 A * 3/1996 Moynihan ..... B41J 2/025 29/25.35

FOREIGN PATENT DOCUMENTS

JP 4078629 B2 4/2008

* cited by examiner

*Primary Examiner* — Bradley W Thies

(57) ABSTRACT

A piezoelectric print head includes a piezoelectric element; a nozzle that ejects liquid when the piezoelectric element is driven; a transmission gate that switches between supply and non-supply of a driving signal for driving the piezoelectric element to the piezoelectric element; a history-information memory that holds history information indicating history of ON or OFF of the transmission gate; and a switch-operation stop controller that stops a switch operation that causes the transmission gate to be turned OFF from ON or to be turned ON from OFF, in accordance with the history information.

14 Claims, 9 Drawing Sheets

FIG. 7A

| | Sl[m] (b1, b2) | Ts1 | Ts2 |
|---|---|---|---|
| | | SLa[m] | SLa[m] |
| LARGE DOT | (1, 1) | H | H |
| MEDIUM DOT | (1, 0) | H | L |
| SMALL DOT | (0, 1) | L | H |
| MICRO-VIBRATION | (0, 0) | L | L |

FIG. 7B

| | Sl[m] (b1, b2) | Ts1 | Ts2 |
|---|---|---|---|
| | | SLb[m] | SLb[m] |
| LARGE DOT | (1, 1) | L | L |
| MEDIUM DOT | (1, 0) | L | H |
| SMALL DOT | (0, 1) | L | L |
| MICRO-VIBRATION | (0, 0) | H | L |

FIG. 7C

| | Sl[m] (b1, b2) | Ts1 | Ts2 |
|---|---|---|---|
| | | SLb[m] | SLb[m] |
| LARGE DOT | (1, 1) | L | L |
| MEDIUM DOT | (1, 0) | L | H |
| SMALL DOT | (0, 1) | L | L |
| MICRO-VIBRATION | (0, 0) | L | L |

PIEZOELECTRIC PRINT HEAD AND PIEZOELECTRIC INK JET PRINTER

This application claims priority to Japanese Patent Application No. 2017-186450 filed on Sep. 27, 2017. The entire disclosure of Japanese Patent Application No. 2017-186450 is hereby incorporated herein by reference.

BACKGROUND

1. Technical Field

The present invention relates to a technology that uses a piezoelectric element for ejecting liquid such as ink.

2. Related Art

On-demand ink jet printers are roughly divided into thermal type that uses a heat generating element, and piezoelectric type that uses a piezoelectric element, as a driving element for ejecting liquid.

The piezoelectric type is more advantageous than the thermal type because the piezoelectric type does not heat ink and hence can handle various kinds of ink, and can precisely control the ejection amount of ink. In the technical field of such a piezoelectric ink jet printer, there is known a print head having a thin-film piezoelectric developed through application of micro electro mechanical systems (MEMS) technology (see Japanese Patent No. 4,078,629). The MEMS technology enables micromachining, and hence nozzles that eject ink can be highly densely arranged in the piezoelectric print head.

However, as the density of arrangement of the piezoelectric print head increases, the heat amount per unit volume increases. The increase in heat amount changes the composition of ink and the properties of ink such as viscosity, thereby increasing the risk of deterioration of ink. The increase in the risk of deterioration represents an increase in possibility that an intended product cannot be obtained due to ejection failure or deterioration of ink. This may impair the advantage of the piezoelectric print head of ejecting various kinds of liquid such as ink without applying heat to the liquid.

SUMMARY

An advantage of some aspects of the invention is reducing the risk of deterioration of liquid to be ejected from a piezoelectric print head.

According to a first aspect of the invention, there is provided a piezoelectric print head including a piezoelectric element, a nozzle that ejects liquid when the piezoelectric element is driven, a switch that switches between supply and non-supply of a driving signal for driving the piezoelectric element to the piezoelectric element, a history-information memory that holds history information indicating history of ON or OFF of the switch, and a switch-operation stop controller that stops a switch operation that causes the switch to be turned OFF from ON or to be turned ON from OFF, in accordance with the history information.

With the aspect, the driving signal is supplied to the piezoelectric element via the switch. Electric power is consumed and heat is generated with the switch operation. The switch-operation stop controller can stop the switch operation in accordance with the history of ON or OFF of the switch. Thus, a temperature rise of the piezoelectric print head is suppressed and hence the risk of deterioration of liquid can be decreased, and further current consumption can be decreased.

In this case, the liquid may have properties that are deteriorated at a temperature lower than 100° C. When liquid to be ejected from a nozzle has properties that are deteriorated at a temperature lower than 100° C., the generation of heat with the switch operation is a serious problem.

With the aspect, for liquid using alcohol-based liquid as a solvent whose boiling point is at a temperature from 70° C. to 90° C., liquid using water as a solvent whose boiling point is at a temperature from 90° C. to 100° C., and liquid whose boiling point is at a temperature lower than the above, generation of heat with the switch operation is suppressed and hence the risk of deterioration of liquid can be decreased, and the properties of liquid to be ejected can be stable.

In this case, 400 or more nozzles including the nozzle may be arranged in a row with a density of 300 or more nozzles per inch, and the piezoelectric element, the switch, the history-information memory, and the switch-operation stop controller may be provided for each of the 400 or more nozzles.

When the 400 or more nozzles are arranged in a row with the density of 300 nozzles or more per inch, the temperature per unit volume largely rises due to the generation of heat with the switch operation corresponding to the individual nozzle. With the aspect, the generation of heat with the switch operation can be decreased. Thus, a temperature rise of the piezoelectric print head is suppressed and hence the risk of deterioration of liquid can be decreased, and further current consumption can be decreased.

In this case, the driving signal may include a micro-vibration waveform that causes the liquid not to be ejected when the micro-vibration waveform is supplied to the piezoelectric element; the history-information memory may include a counter that counts a number of supply times of the micro-vibration waveform that is successively supplied to the piezoelectric element through ON or OFF of the switch; and the history information may be a count value of the counter.

When liquid is ejected from a nozzle, liquid in the nozzle is influenced by heat generated by the piezoelectric print head and the liquid at an increased temperature is ejected. Instead of the liquid at the increased temperature, the nozzle is filled with liquid that is not influenced by the heat generated by the piezoelectric print head and hence that is at a relatively low temperature. Since the nozzle is filled with the liquid at a temperature lower than the temperature of the liquid with which the nozzle was filled until then, the inside of the piezoelectric print head is cooled. In contrast, with micro-vibration, liquid is not ejected. Hence, the cooling effect due to ejection of liquid and filling with new liquid is not obtained, and consequently the temperature relatively rises with the switch operation. With the aspect, since the number of times micro-vibration is successively made is counted and the switch operation can be stopped in accordance with the count value, the influence of heat received by liquid is suppressed and hence the risk of deterioration of liquid can be decreased. Furthermore, the difference in temperature of liquid in the plurality of nozzles of the piezoelectric print head is decreased, and hence ejection can be stable.

In this case, the driving signal may include an ejection waveform that causes the liquid to be ejected when the ejection waveform is supplied to the piezoelectric element;

and when the ejection waveform is supplied to the piezoelectric element through ON or OFF of the switch, the count value of the counter may be reset.

When liquid is ejected from a nozzle, liquid in the nozzle is influenced by heat generated by the piezoelectric print head and the liquid at an increased temperature is ejected. Instead of the liquid at the increased temperature, the nozzle is filled with liquid that is not influenced by the heat generated by the piezoelectric print head and hence that is at a relatively low temperature. Since the nozzle is filled with the liquid at a temperature lower than the temperature of the liquid with which the nozzle was filled until then, the inside of the piezoelectric print head is cooled. With this aspect, the count value is reset in accordance with the ejection of liquid at an increased temperature due to the influence of heat generated by the piezoelectric print head. Hence, the stop of the switch operation is minimized, and the environment suitable for decreasing the risk of deterioration of liquid can be provided without using a particular thermometer.

In this case, the switch-operation stop controller may stop the switch while the switch is OFF if the count value is a predetermined number or larger.

With this aspect, the switch operation can be stopped and turned OFF if the number of successive supply times of micro-vibration is a predetermined number or more. Hence, the effect of decreasing the viscosity of liquid by micro-vibration and the effect of decreasing the temperature rise of liquid can be well balanced based on the predetermined number.

In this case, the piezoelectric print head may further include a circuit board provided with an output circuit that outputs a select signal that causes the switch to be turned ON or OFF, the switch, the history-information memory, and the switch-operation stop controller; and a pressure chamber filled with liquid and having an internal pressure that increases and decreases in accordance with driving of the piezoelectric element. The piezoelectric element may be provided in a sealed space that is defined by a plurality of members including the circuit board.

With the aspect, since the sealed space is defined by the plurality of members including the circuit board, the distance between the circuit board and the pressure chamber filled with the liquid is a small distance. Thus, the heat generated by the output circuit and the switch is likely transferred to the liquid in the pressure chamber via the plurality of members. The switch-operation stop controller can stop the switch operation in accordance with the history of ON or OFF of the switch. Thus, a temperature rise of the piezoelectric print head can be decreased.

According to a second aspect of the invention, there is provided a piezoelectric ink jet printer including any one of the above-described piezoelectric print heads, and the liquid is ink. With this aspect, the temperature rise of the piezoelectric print head can be decreased. Hence, the temperature rise of ink can be suppressed, and printing with high quality can be provided.

BRIEF DESCRIPTION OF THE DRAWINGS

The invention will be described with reference to the accompanying drawings, wherein like numbers reference like elements.

FIG. 7A is an explanatory view showing decoding contents of a first processor.

FIG. 7B is an explanatory view showing decoding contents of a decoder circuit.

FIG. 7C is an explanatory view showing decoding contents of a second processor.

DESCRIPTION OF EXEMPLARY EMBODIMENTS

Figure 1:
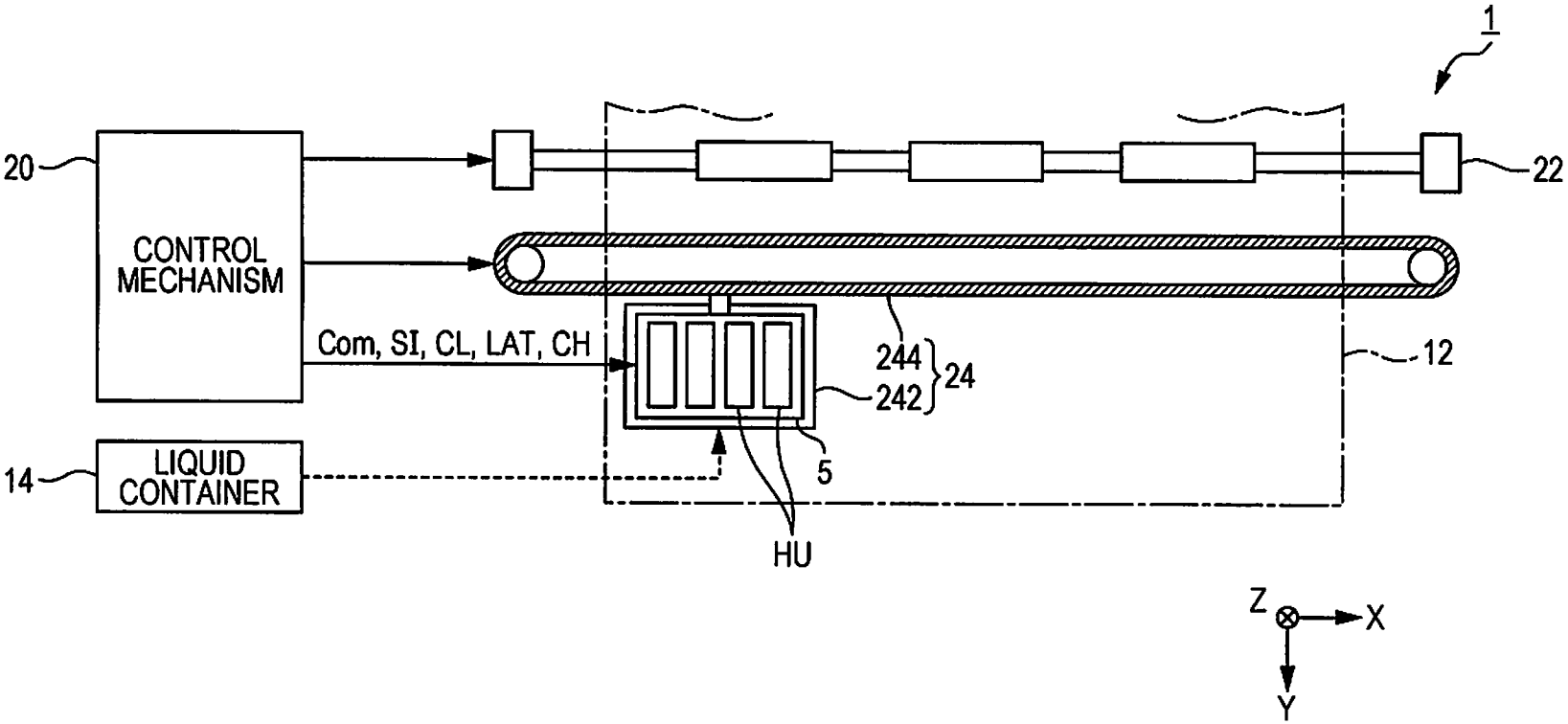
FIG. 1 is a configuration diagram of a piezoelectric ink jet printer according to an embodiment of the invention.

An embodiment for implementing the invention is described below with reference to the drawings. The dimensions and scales of portions in the drawings are properly differentiated from the dimensions and scales of actual portions. Also, an embodiment to be described below is a desirable specific example of the invention, and hence has various technically desirable limitations; however, the scope of the invention is not limited to the embodiment unless otherwise noted to limit the invention in the following description.

1. Embodiment

A piezoelectric ink jet printer 1 according to an embodiment is described below with reference to the drawings.

1-1. Overview of Piezoelectric Ink Jet Printer

FIG. 1 is a configuration diagram showing the piezoelectric ink jet printer 1 according to the embodiment. The piezoelectric ink jet printer 1 according to the embodiment ejects ink, which is an example of liquid, to a medium 12. The medium 12 is typically printing paper; however, any printing object, such as a resin film, a fabric, or a color filter of an organic electroluminescence (EL) display may be used as the medium 12.

As shown in FIG. 1, the piezoelectric ink jet printer 1 includes a liquid container 14 that stores ink. The liquid container 14 may employ, for example, a cartridge attachable to and detachable from the piezoelectric ink jet printer 1, a bag-shaped ink pack formed of a flexible film, or an ink tank that can be replenished with ink. The liquid container 14 stores a plurality of kinds of ink having different colors.

As shown in FIG. 1, the piezoelectric ink jet printer 1 includes a control mechanism 20, a transport mechanism 22, a movement mechanism 24, and a plurality of piezoelectric print heads HU.

The control mechanism 20 includes, for example, a processing circuit, such as a central processing unit (CPU) or a field programmable gate array (FPGA), and a memory circuit such as a semiconductor memory. The control mechanism 20 controls respective elements of the piezoelectric ink jet printer 1. In this embodiment, the transport mechanism 22 transports the medium 12 to the +Y side under the control of the control mechanism 20. In the following description, the +Y side, and the −Y side which is a side opposite to the +Y side may be collectively referred to as the Y-axis direction.

The movement mechanism 24 reciprocates the plurality of piezoelectric print heads HU to the +X side, and the −X side opposite to the +X side under the control of the control mechanism 20. In this case, the +X side is in a direction intersecting with (typically, orthogonal to) the +Y side to which the medium 12 is transported. Hereinafter, the +X side and the −X side may be collectively referred to as the X-axis direction. The movement mechanism 24 has a carriage body (carriage) 242 that houses a head section 5, and an endless belt 244 to which the carriage body 242 is fixed. Alternatively, the liquid container 14 may be mounted on the carriage body 242 together with the piezoelectric print heads HU.

The head section 5 includes the plurality of piezoelectric print heads HU. Each of the plurality of piezoelectric print heads HU is supplied with ink from the liquid container 14. Moreover, each of the plurality of piezoelectric print heads HU receives, supplied from the control mechanism 20, a driving signal Com for driving each piezoelectric print head HU, a latch signal LAT for controlling an ejection timing, a change signal CH for selecting a waveform to be supplied from the driving signal Com, and a print signal SI for controlling the piezoelectric print head HU. Each of the plurality of piezoelectric print heads HU is driven based on the driving signal Com under the control based on the print signal SI, the latch signal LAT, and the change signal CH, and causes a portion or the entirety of a number 2M of nozzles (ejection holes) to eject ink to the +Z side (M is a natural number equal to or more than 1).

In this case, the +Z side is in a direction intersecting with (typically, orthogonal to) the +X side and the +Y side. In the following description, the +Z side, and the −Z side which is a side opposite to the +Z side may be collectively referred to as the Z-axis direction. Each piezoelectric print head HU forms a desirable image on a surface of the medium 12, by causing a portion or the entirety of the number 2M of nozzles to eject ink and allowing the ejected ink to be landed on the surface of the medium 12, in association with the transport of the medium 12 by the transport mechanism 22 and the reciprocation of the carriage body 242.

Although the details will be described later, in this embodiment, a high-density piezoelectric print head HU is employed. In this case, high density represents arrangement of nozzles that eject ink with a density of 300 or more nozzles per inch.

With the piezoelectric type, a driving signal Com is selectively supplied to a piezoelectric element via a switch such as a transmission gate. To reduce erroneous ejection due to a malfunction of the switch, the switch is designed to have a sufficiently high on-resistance. Thus, large electric power is consumed with the switch operation, and the switch is one of heat generating factors in the piezoelectric print head. Moreover, with the switch operation of turning the switch OFF from ON or ON from OFF, an output circuit that supplies a select signal to the switch is also one of the heat generating factors in the piezoelectric print head.

When the temperature rises because the switch and the output circuit generate heat, the temperature of ink also rises due to thermal conduction. The change in temperature of ink changes the composition of ink and the properties of ink such as viscosity, thereby increasing the risk of deterioration of ink. Since the piezoelectric print head HU is more advantageous than the thermal print head because the piezoelectric print head HU can eject ink without applying heat to the ink unlike the thermal print head, the ink to be used involves many types of ink sensitive to heat. The temperature rise markedly degrades the advantage of the piezoelectric print head HU.

Particularly with a high-density piezoelectric print head HU in which nozzles are highly densely arranged, due to an increase in density, the heat amount and thermal conduction efficiency to ink increase, and heat release efficiency to the outside decreases.

If a non-ejection state of ink continues, the viscosity of ink may increase and the ink may clog a nozzle. Owing to this, a piezoelectric element may be driven to stir ink and suppress settlement of the ink while the ink is not ejected. This operation is referred to as micro-vibration. When the print signal SI designates micro-vibration, the ink is not ejected but the heat generated by the switch and the output circuit is transferred to the ink.

Figure 2:
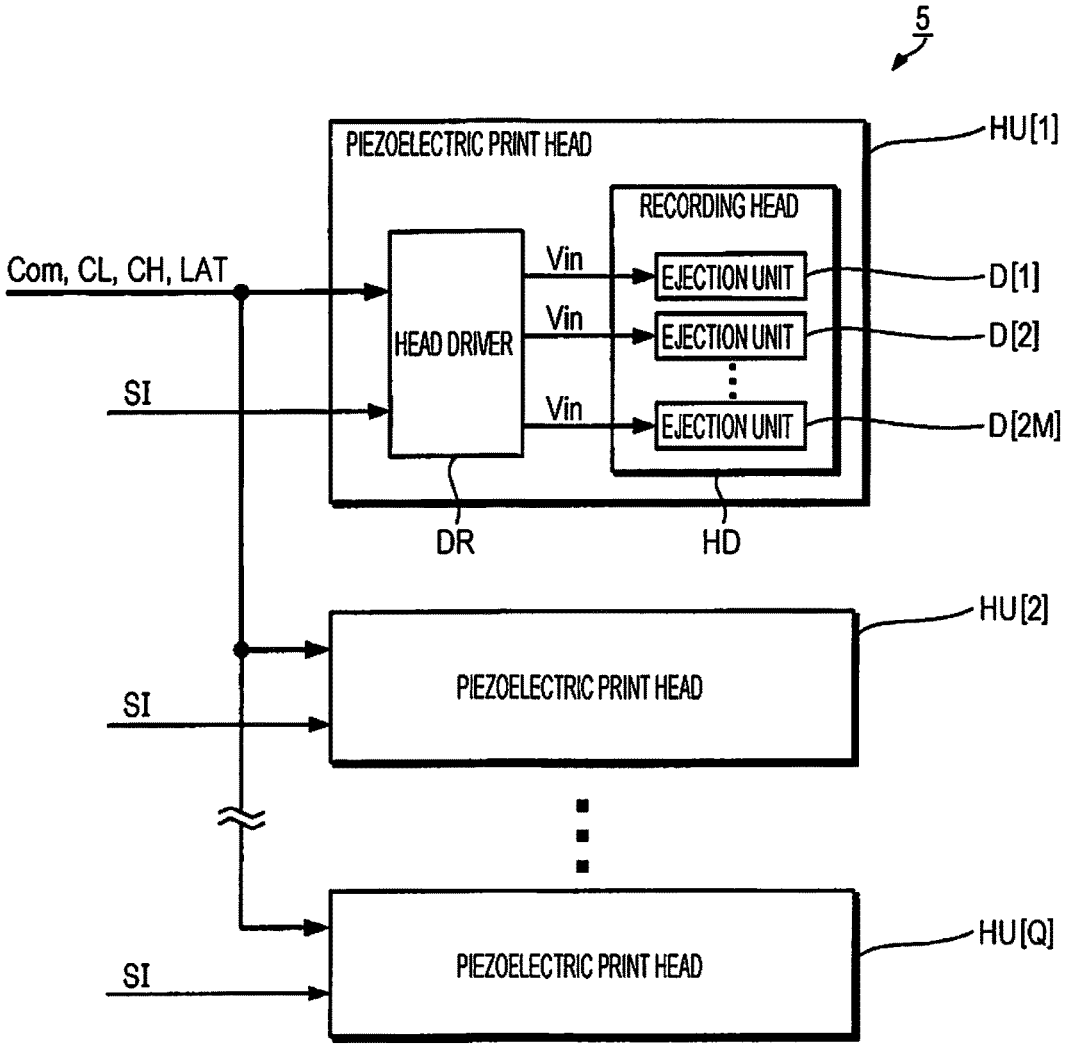
FIG. 2 is a block diagram showing an electric configuration of a head section.

When ink is ejected, ink at an increased temperature is output to the outside with the ejection, and instead of the ink at the increased temperature, ink at a relatively low temperature flows into the nozzle. The temperature in the nozzle decreases. However, in the case of micro-vibration, the temperature is not decreased with the ejection of ink. In this embodiment, the number of times of micro-vibration to be successively supplied to the piezoelectric element is counted, and if the count is a predetermined value or more, the switch operation is stopped. Thus, generation of heat by the piezoelectric print head HU is suppressed. Since the generation of heat of the piezoelectric print head HU can be suppressed as described above, the piezoelectric ink jet printer 1 according to this embodiment has a great degree of freedom in ink selection. For example, liquid such as ink whose properties are deteriorated at a temperature lower than 100° C. may be used. Examples of liquid may be liquid using alcohol-based liquid as a solvent whose boiling point is at a temperature from 70° C. to 90° C., liquid using water as a solvent whose boiling point is at a temperature from 90° C. to 100° C., and liquid whose boiling point is at a temperature lower than the above. 1-2. Electric Configuration of Piezoelectric Print Head HU As shown in FIG. 2, the head section 5 includes a number Q of piezoelectric print heads HU (HU[1] to HU[Q])(Q is a natural number of 2 or larger). A q-th piezoelectric print head HU[q] includes a head driver DR and a recording head HD like a first piezoelectric print head HU[1] (q is a natural number satisfying $1 \leq q \leq Q$). The recording head HD includes a number 2M of ejection units D.

In the following description, the number 2M of ejection units D are occasionally sequentially referred to as 1st stage, 2nd stage, . . . , and 2M-th stage, in order to distinguish the number 2M of ejection units D from one another. In the following description, an m-th-stage ejection unit D among the ejection units D provided on the recording head HD is occasionally expressed as ejection unit D[m] (a variable m is a natural number satisfying $1 \leq m \leq 2M$).

The driving signal Com, the clock signal CL, the change signal CH, and the latch signal LAT are supplied from the control mechanism 20 commonly to the number Q of piezoelectric print heads HU[1] to HU[Q]. Also, the print signals SI are supplied individually to the respective number Q of piezoelectric print heads HU[1] to HU[Q]. The print signals SI are signals that correspond to the ejection units D[1] to D[2M] in a one-to-one correspondence, and that designate the amounts of ink to be ejected from the ejection units D[1] to D[2M].

The driving signal Com is an analog signal having a plurality of waveforms for driving the ejection unit D. The driving signal Com includes a driving signal Com-A and a driving signal Com-B (see FIG. 8). For example, the control mechanism 20 includes a digital-to-analog (DA) converter circuit (not shown), converts a digital driving waveform signal that is generated by the CPU or the like included in the control mechanism 20 into an analog driving signal Com, and outputs the driving signal Com.

As described above, the piezoelectric print head HU[q] includes the head driver DR and the recording head HD. The head driver DR generates individual driving signals Vin for driving the ejection units D[1] to D[2M] included in the recording head HD, based on various signals, such as the driving signal Com, the print signals SI, and the change signal CH supplied from the control mechanism 20.

1-3. Structure of Recording Head

Figure 3:
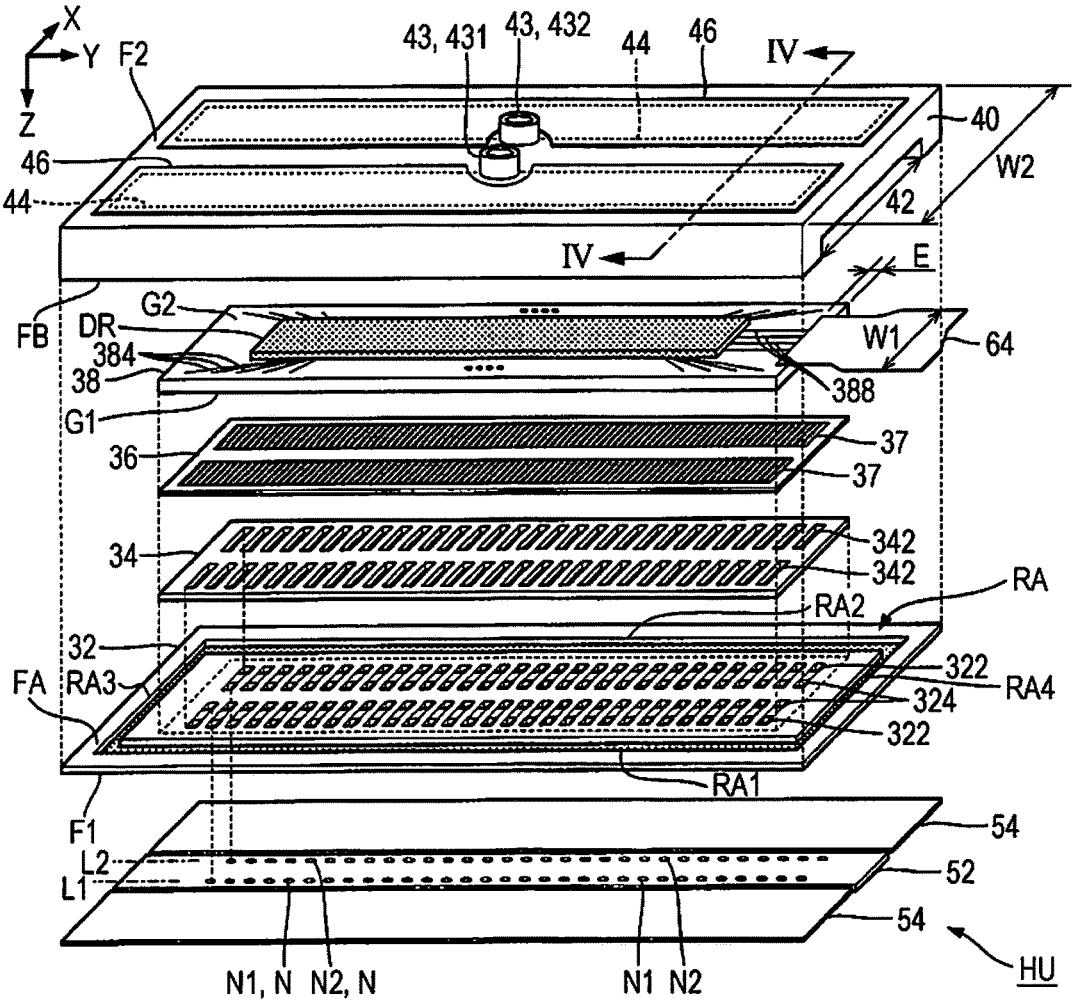
FIG. 3 is an exploded perspective view of a piezoelectric print head.
Figure 4:
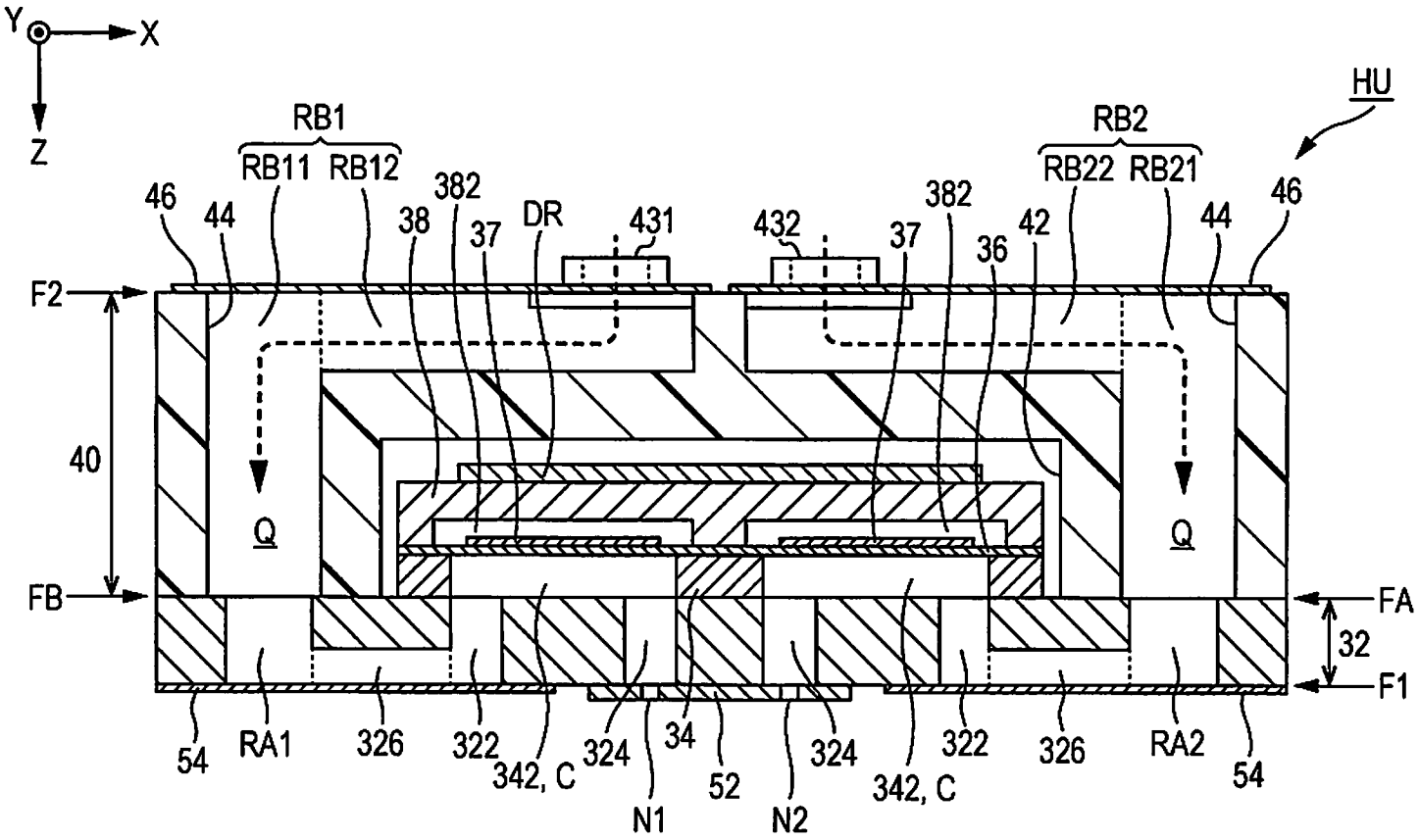
FIG. 4 is a sectional view of the piezoelectric print head.

FIG. 3 is an exploded perspective view of each piezoelectric print head HU. FIG. 4 is a sectional view taken along line IV-IV in FIG. 3.

As shown in FIG. 3, the piezoelectric print head HU includes a number 2M of nozzles N arrayed in the Y-axis direction. In this embodiment, the number 2M of nozzles N are arrayed to be divided into two rows of a row L1 and a row L2. In the following description, each of a number M of nozzles N belonging to the row L1 may be referred to as nozzle N1, and each of a number M of nozzles N belonging to the row L2 may be referred to as nozzle N2. In this embodiment, it is expected that, as an example, the position of a j-th nozzle N1 from the −Y side of the number M of nozzles N1 belonging to the row L1 is substantially the same in the Y-axis direction as the position of a j-th nozzle N2 from the −Y side of the number M of nozzles N2 belonging to the row L2 (j is a natural number satisfying $1 \leq j \leq M$). In this case, "substantially the same" is conception involving a situation being completely the same, and a situation being apparently the same within tolerance.

Alternatively, the number 2M of nozzles N may be arrayed in a zigzag manner or a staggered manner such that the position of the j-th nozzle N1 from the −Y side of the number M of nozzles N1 belonging to the row L1 is different in the Y-axis direction from the position of the j-th nozzle N2 from the −Y side of the number M of nozzles N2 belonging to the row L2.

As shown in FIGS. 3 and 4, the piezoelectric print head HU includes a channel substrate 32. The channel substrate 32 is a plate-shaped member having a surface F1 and a surface FA. The surface F1 is a surface on the +Z side (a surface on the medium 12 side when viewed from the piezoelectric print head HU). The surface FA is a surface (on the −Z side) opposite to the surface F1. A pressure-chamber substrate 34, a vibration portion 36, a plurality of piezoelectric elements 37, a protection member 38, and a casing 40 are provided on or above the surface FA. A nozzle plate 52 and a vibration absorber 54 are provided on the surface F1. Respective elements of the piezoelectric print head HU are generally plate-shaped members long in the Y-axis direction like the channel substrate 32. Respective components are joined to one another by using, for example, an adhesive. Note that the direction in which the channel substrate 32, the pressure-chamber substrate 34, the protection member 38, and the nozzle plate 52 are stacked can be recognized as the Z-axis direction.

The nozzle plate 52 is a plate-shaped member having the number 2M of nozzles N formed therein. For example, the nozzle plate 52 is provided on the surface F1 of the channel substrate 32 by using, for example, an adhesive. The nozzles N are through-holes provided in the nozzle plate 52. The nozzle plate 52 is manufactured, for example, by processing a monocrystal substrate of silicon (Si) by using a semiconductor manufacturing technology such as etching. Note that a known material and a known manufacturing method may be desirably employed for manufacturing the nozzle plate 52.

In this embodiment, it is expected that the nozzle plate 52 has the number M of nozzles N corresponding to each of the row L1 and the row L2 with a density of 300 nozzles or more per inch. Note that the nozzle plate 52 may have the number M of nozzles N corresponding to each of the row L1 and the row L2 with a density of 100 nozzles or more per inch, and further preferably with a density of 200 nozzles or more per inch. Alternatively, M may be 400 or more. In this case, 400 or more nozzles N are arrayed in each of the row L1 and the row L2.

The channel substrate 32 is a plate-shaped member that forms a channel of ink. As shown in FIGS. 3 and 4, the channel substrate 32 has a channel RA. The channel RA includes a channel RA1 provided to correspond to the row L1, a channel RA2 provided to corresponds to the row L2, a channel RA3 that couples the channel RA1 to the channel RA2, and a channel RA4 that couples the channel RA1 to the channel RA2. The channel RA1 is an opening formed to extend long in the Y-axis direction. The channel RA2 is an opening located on the +X side when viewed from the channel RA1, and formed to extend long in the Y-axis direction.

The channel substrate 32 has a number 2M of channels 322 and a number 2M of channels 324 (an example of "communication channels") to correspond to the number 2M of nozzles N in a one-to-one correspondence. The channels 322 and the channels 324 are openings formed to extend through the channel substrate 32 as shown in FIG. 4. The channels 324 communicate with the nozzles N corresponding to the channels 324.

Furthermore, two channels 326 are formed in the surface F1 of the channel substrate 32 as shown in FIG. 4. One of the two channels 326 is a channel that couples the channel RA1 to the number M of channels 322 corresponding to the number M of nozzles N1 belonging to the row L1 in a one-to-one correspondence, and the other one of the two channels 326 is a channel that couples the channel RA2 to the number M of channels 322 corresponding to the number M of nozzles N2 belonging to the row L2 in a one-to-one correspondence.

As shown in FIGS. 3 and 4, the pressure-chamber substrate 34 is a plate-shaped member having a number 2M of openings 342 to correspond to the number 2M of nozzles N in a one-to-one correspondence. The pressure-chamber substrate 34 is mounted on the surface FA of the channel substrate 32, for example, by using an adhesive.

The channel substrate 32 and the pressure-chamber substrate 34 are manufactured, for example, by processing a monocrystal substrate of silicon (Si) by using a semiconductor manufacturing technology. Note that a known material and a known manufacturing method may be desirably employed for manufacturing the channel substrate 32 and the pressure-chamber substrate 34.

As shown in FIGS. 3 and 4, the vibration portion 36 is provided on a surface of the pressure-chamber substrate 34 opposite to the channel substrate 32. The vibration portion 36 is a plate-shaped member configured to elastically vibrate. Alternatively, the pressure-chamber substrate 34 and the vibration portion 36 may be integrally formed by selectively removing a portion in the plate-thickness direction of the plate-shaped member that forms the vibration portion 36 in a region corresponding to the openings 342.

As it is understood from FIG. 4, the vibration portion 36 opposes the surface FA of the channel substrate 32 with a space interposed therebetween at the inside of each opening 342. The space between the surface FA of the channel substrate 32 and the vibration portion 36 at the inside of the opening 342 functions as a pressure chamber C that applies a pressure to the ink filled in the space. That is, in this embodiment, the vibration portion 36 is an example of "a vibration plate" that forms a wall surface of the pressure chamber C. The pressure chamber C is, for example, a space having a long-side direction in the X-axis direction and a short-side direction in the Y-axis direction. The piezoelectric print head HU has a number 2M of pressure chambers C to correspond to the number 2M of nozzles N in a one-to-one correspondence. As shown in FIG. 4, the pressure chambers C provided to correspond to the nozzles N1 communicate with the channel RA1 via the channels 322 and the channel 326, and communicate with the nozzles N1 via the channels 324. Also, the pressure chambers C provided to correspond to the nozzles N2 communicate with the channel RA2 via the channels 322 and the channel 326, and communicate with the nozzles N2 via the channels 324.

As shown in FIGS. 3 and 4, a number 2M of piezoelectric elements 37 are provided on a surface of the vibration portion 36 opposite to the pressure chambers C, to correspond to the number 2M of pressure chambers C in a one-to-one correspondence. Each piezoelectric element 37 is a passive element that is deformed in accordance with supply of the driving signal Com.

As described above, each piezoelectric element 37 is deformed (driven) in accordance with the supply of the driving signal Com. The vibration portion 36 vibrates in association with the deformation of the piezoelectric element 37. When the vibration portion 36 vibrates, the pressure in the corresponding pressure chamber C varies. Then, when the pressure in the pressure chamber C varies, the ink filled in the pressure chamber C is ejected through the corresponding channel 324 and the corresponding nozzle N. In this embodiment, it is expected that the driving signal Com can drive the piezoelectric element 37 so that the ink is ejected from the nozzle N 30,000 times or more per second.

Note that the pressure chamber C, the channel 322, the nozzle N, the vibration portion 36, and the piezoelectric element 37 function as an ejection unit D that ejects the ink filled in the pressure chamber C.

The protection member 38 shown in FIGS. 3 and 4 is a plate-shaped member that protects the number 2M of piezoelectric elements 37 formed on the vibration portion 36. The protection member 38 is provided on a surface of the vibration portion 36 or a surface of the pressure-chamber substrate 34. That is, in this embodiment, the protection member 38 is provided above the ejection units. The protection member 38 is manufactured, for example, by processing a monocrystal substrate of silicon (Si) by using a semiconductor manufacturing technology. Note that a known material and a known manufacturing method may be desirably employed for manufacturing the protection member 38.

The protection member 38 has two housing spaces 382 in a surface G1 which is a surface of the protection member 38 on the +Z side. One of the two housing spaces 382 houses the number M of piezoelectric elements 37 corresponding to the number M of nozzles N1. The other one of the two housing spaces 382 houses the number M of piezoelectric elements 37 corresponding to the number M of nozzles N2. The housing space 382 functions as "a sealed space" in which the piezoelectric elements 37 are sealed to protect the piezoelectric elements 37 from being deteriorated due to the influence of, for example, oxygen or moisture when the protection member 38 is arranged above the ejection units. Note that the width in the Z-axis direction (height) of each housing space 382 (or each sealed space) is sufficiently large so that the piezoelectric elements 37 do not contact the protection member 38 even when the piezoelectric elements 37 are displaced. Thus, even when the piezoelectric elements 37 are displaced, the noise caused by the displacement of the piezoelectric elements 37 is prevented from propagating to the outside of the housing space 382 (or the sealed space).

The head driver DR is provided on a surface G2 which is a surface of the protection member 38 on the −Z side. That is, the protection member 38 functions as "a circuit board" for mounting the head driver DR.

The head driver DR switches between supply and non-supply of the driving signal Com to each piezoelectric element 37 under the control of the print signal SI. While the driving signal Com is generated by the control mechanism 20 in this embodiment, the invention is not limited to such an aspect, and the driving signal Com may be generated by the head driver DR.

As shown in FIGS. 3 and 4, the head driver DR according to this embodiment overlaps at least partial piezoelectric elements 37 of the number 2M of piezoelectric elements 37 provided on the piezoelectric print head HU in a plan view. Also, the head driver DR according to this embodiment overlaps both piezoelectric elements 37 corresponding to the nozzles N1 and piezoelectric elements 37 corresponding to the nozzles N2 in a plan view.

Figure 5:
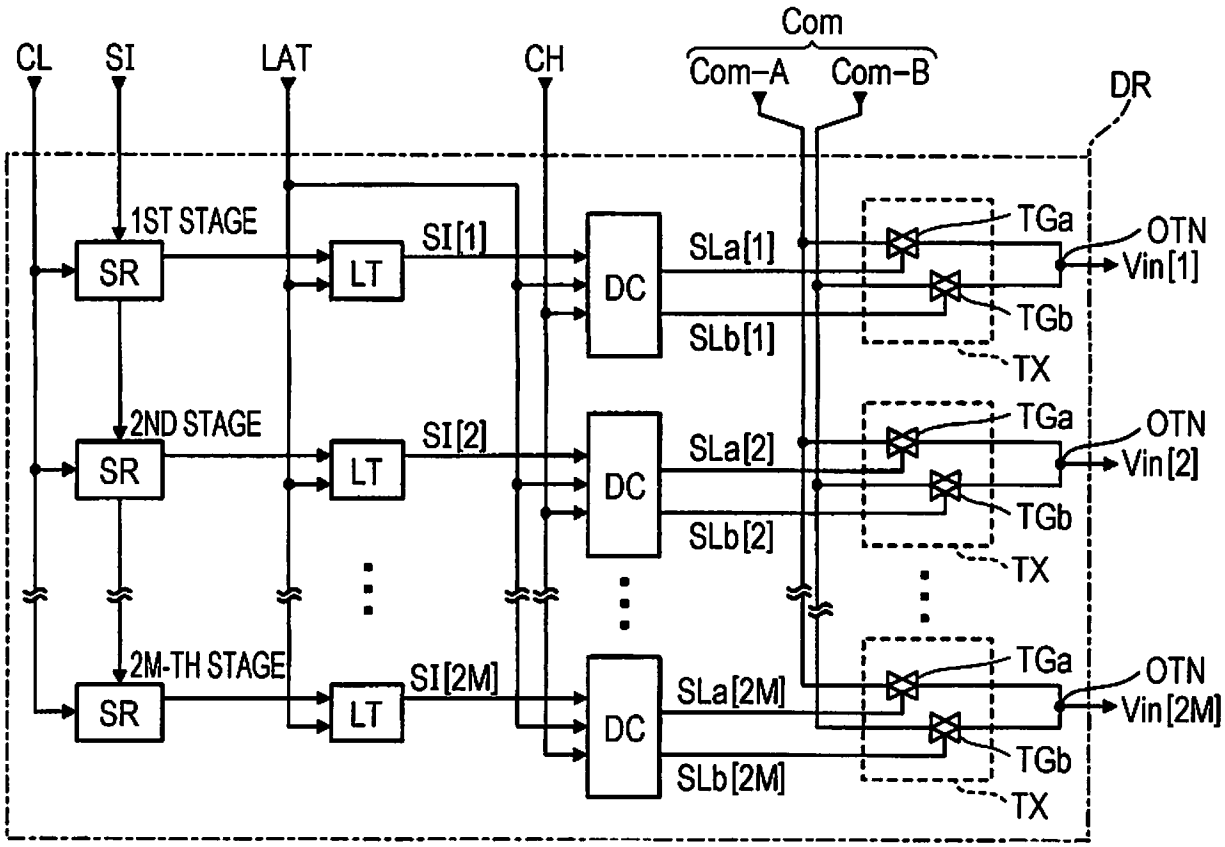
FIG. 5 is a block diagram showing an electric configuration of a head driver.

As shown in FIG. 3, a number 2M of wiring 384 are formed on the surface G2 of the protection member 38, for example, to correspond to the number 2M of piezoelectric elements 37 in a one-to-one correspondence. The wiring 384 each are electrically coupled to the head driver DR. Also, as shown in FIG. 5, the wiring 384 each are electrically coupled to a connection terminal provided on the surface G1 via a continuity hole (contact hole) extending through the protection member 38. The connection terminal is electrically coupled to an electrode of the corresponding piezoelectric element 37. Thus, the driving signal Com output from the head driver DR is supplied to the piezoelectric element 37 via the wiring 384, the continuity hole, and the connection terminal.

In addition, as shown in FIG. 3, a plurality of wiring 388 are formed on the surface G2 of the protection member 38, and are electrically coupled to the head driver DR. The plurality of wiring 388 extend to a region E which is an end portion on the +Y side of the surface G2 of the protection member 38. A wiring member 64 is joined to the region E of the surface G2. The wiring member 64 is a component having a plurality of wiring that electrically couple the control mechanism 20 to the head driver DR. For example, the wiring member 64 may be a flexible wiring substrate, such as a flexible printed circuit (FPC) or a flexible flat cable (FFC).

As shown in FIGS. 3 and 4, the casing 40 is a case that stores ink to be supplied to the number 2M of pressure chambers C (and further the number 2M of nozzles N). A surface FB which is a surface on the +Z side of the casing 40 is fixed to the surface FA of the channel substrate 32, for example, by using an adhesive. As shown in FIGS. 3 and 4, the surface FB of the casing 40 has a recess 42 having a groove shape extending in the Y-axis direction. The protection member 38 and the head driver DR are housed in the recess 42. The wiring member 64 joined to the region E of the protection member 38 extends in the Y-axis direction to pass through the inside of the recess 42. As it is understood from FIG. 3, a width W1 (the maximum value of the dimension in the X-axis direction) of the wiring member 64 is smaller than a width W2 of the casing 40 (W1<W2).

In this embodiment, the casing 40 is formed of a material different from the materials of the channel substrate 32 and the pressure-chamber substrate 34. The casing 40 is formed, for example, by injection molding a resin material. Note that a known material and a known manufacturing method may be desirably employed for manufacturing the casing 40. The material of the casing 40 may be, for example, synthetic fiber such as poly p-phenylenebenzobisoxazole (Zylon (registered trademark)); or a resin material such as a liquid crystal polymer.

As shown in FIG. 4, the casing 40 has a channel RB. The channel RB includes a channel RB1 that communicates with the channel RA1, and a channel RB2 that communicates with the channel RA2. The channel RA and the channel RB function as reservoirs Q that store ink to be supplied to the number 2M of pressure chambers C.

Two inlets 43 through which ink supplied from the liquid container 14 is introduced to the reservoirs Q are provided in a surface F2 which is a surface on the −Z side of the casing 40. One of the two inlets 43 (hereinafter, occasionally referred to as inlet 431) communicates with the channel RB1, and the other one of the two inlets 43 (hereinafter, occasionally referred to as inlet 432) communicates with the channel RB2.

As shown in FIG. 4, the channel RB1 is a space long in the Y-axis direction, and includes a channel RB11 that communicates with the channel RA1, and a channel RB12 that communicates with the inlet 43. The channel RB2 is a space long in the Y-axis direction, and includes a channel RB21 that communicates with the channel RA2, and a channel RB22 that communicates with the inlet 43.

As it is understood from FIG. 4, the protection member 38 and the head driver DR are located between the channel RB11 and the channel RB21. That is, the protection member 38 and the head driver DR are provided in a space between the channel RB11 and the channel RB21. In other words, in a sectional view in the X-axis direction (from the +X side or the −X side), the region where the protection member 38 and the head driver DR are provided is included in the region where the channel RB11 or the channel RB21 is provided.

Also, as it is understood from FIG. 4, in a plan view from the +Z side or the −Z side, at least a portion of the protection member 38 and at least a portion of the head driver DR are located between the channel RB12 or the channel RB22 and the pressure chambers C. That is, at least a portion of the protection member 38 and at least a portion of the head driver DR are provided between the reservoir Q and the pressure chambers C.

Also, as it is understood from FIG. 4, at least a portion of the protection member 38 and at least a portion of the head driver DR are located between the piezoelectric elements 37 and the channel RB12 or the channel RB22. At least a portion of the protection member 38 and at least a portion of the head driver DR are provided between the reservoir Q and the piezoelectric elements 37. In other words, in a plan view, at least a portion of the reservoir Q overlaps at least a portion of the protection member 38, at least a portion of the head driver DR, and at least a portion of the piezoelectric elements 37.

As shown by a broken-line arrow in FIG. 4, the ink supplied from the liquid container 14 to the inlet 431 flows into the channel RA1 via the channel RB12 and the channel RB11. Part of the ink flowing into the channel RA1 is supplied to the pressure chambers C corresponding to the nozzles N1 via the channel 326 and the channels 322. For example, the ink filled in the pressure chambers C corresponding to the nozzles N1 flows through the channels 324 to the +Z side, and is ejected from the nozzles N1.

The ink supplied from the liquid container 14 to the inlet 432 flows into the channel RA2 via the channel RB22 and the channel RB21. Part of the ink flowing into the channel RA2 is supplied to the pressure chambers C corresponding to the nozzles N2 via the channel 326 and the channels 322. For example, the ink filled in the pressure chambers C corresponding to the nozzles N2 flows through the channels 324 to the +Z side, and is ejected from the nozzles N2.

As shown in FIGS. 3 and 4, the two inlets 43 and openings 44 corresponding to the above-described reservoirs Q are formed in the surface F2 of the casing 40. Also, two vibration absorbers 46 are provided on the surface F2 of the casing 40 to close the openings 44. The vibration absorbers 46 each are a flexible film (a compliance substrate) that absorbs a variation in pressure of ink in the corresponding reservoir Q, and forms a wall surface of the reservoir Q.

Also, as shown in FIG. 3, vibration absorbers 54 are provided on the surface F1 of the channel substrate 32 to close the two channels 326 of the channel RA1 and the channel RA2, and the plurality of channels 322. The vibration absorbers 54 each are a flexible film (a compliance substrate) that absorbs a variation in pressure of ink in the reservoir Q, and forms a wall surface of the reservoir Q.

In general, a driving signal Com for driving a piezoelectric element 37 is a large-amplitude signal. Hence, the head driver DR generates heat when supplying the driving signal Com to the piezoelectric element 37. In particular, when the number of times of driving of the piezoelectric element 37 per unit time is large like this embodiment, the amount of heat generated by the head driver DR increases. Also, when the ejection units including the nozzles N and the piezoelectric elements 37 are provided in the piezoelectric print head HU with a high density like this embodiment, the amount of heat per unit area generated by the head driver DR increases. When the head driver DR is downsized to downsize the piezoelectric print head HU, the amount of heat per unit area generated by the head driver DR increases. Further, when the protection member 38 provided with the head driver DR is provided above the ejection unit, the head driver DR and the protection member 38 do not contact the air outside the piezoelectric print head HU. Alternatively, the contact area of the head driver DR and the protection member 38 with respect to the air outside the piezoelectric print head HU decreases. Owing to this, heat release efficiency from the head driver DR decreases, and the head driver DR may be at high temperatures.

In contrast, in this embodiment, the head driver DR and the protection member 38 are provided between the channel RB11 and the channel RB21. Accordingly, in this embodiment, even when the head driver DR and the protection member 38 do not directly contact the air outside the piezoelectric print head HU, the heat generated from the head driver DR can be released via the ink in the reservoirs Q.

Also, in this embodiment, a circulation path is formed in order of "the channel RA1→the channel RA3→the channel RA2→the channel RA4→the channel RA1." Accordingly, in this embodiment, as compared with a configuration in which the reservoirs Q do not have the ink circulation path, the heat generated from the head driver DR can be efficiently released via the ink in the reservoirs Q.

Also, in this embodiment, the head driver DR and the protection member 38 are provided between the reservoirs Q and the pressure chambers C. Accordingly, in this embodiment, the heat generated from the head driver DR can be efficiently released via the ink in the reservoirs Q and the ink in the pressure chambers C.

Also, in this embodiment, the reservoirs Q include the channel RB12 and the channel RB22 that are portions overlapping at least a portion of the protection member 38 and at least a portion of the head driver DR in a plan view. Accordingly, in this embodiment, as compared with a configuration in which the reservoirs Q do not overlap the protection member 38 and the head driver DR in a plan view, the piezoelectric print head HU can be easily downsized and the volume of the reservoirs Q can be easily increased.

Also, in this embodiment, the piezoelectric elements 37 are housed in the housing spaces 382 formed in the surface G1 of the protection member 38, and the head driver DR is provided on the surface G2 of the protection member 38. In other words, in this embodiment, the piezoelectric elements 37 are housed in the back surface of the substrate on which the head driver DR is formed. Accordingly, in this embodiment, as compared with a configuration in which the piezoelectric elements 37 are provided at a location different from the back surface of the substrate on which the head driver DR is formed, the path length of wiring for electrically coupling the head driver DR to the piezoelectric elements 37 can be decreased. Accordingly, in this embodiment, the waveform of the driving signal Com can be prevented from being disordered due to the resistance component and capacity component of the wiring; and the wiring resistance is decreased and the amount of heat generated by the wiring can be decreased.

Also, in this embodiment, since the wiring member 64 is arranged in the region E at the end portion of the protection member 38, as compared with a case where the wiring member 64 extends in a region from an end portion to a position around the center of the protection member 38, the space for arranging the wiring member 64 can be decreased. Accordingly, in this embodiment, the piezoelectric print head HU can be easily downsized, and the volume of the reservoirs Q can be easily increased.

Also, in this embodiment, since the vibration absorbers 54 and 46 absorb a variation in pressure in the reservoirs Q, the possibility that the variation in pressure in the reservoirs Q propagates to the pressure chambers C and changes the ejection characteristics of ink (for example, the ejection amount, ejection speed, ejection direction) can be decreased.

1-4. Configuration and Operation of Head Driver

The configuration and operation of the head driver DR are described next with reference to FIGS. 5 to 9.

FIG. 5 is a block diagram showing the configuration of the head driver DR. As shown in FIG. 5, the head driver DR has a number 2M of groups each including a shift register SR, a latch circuit LT, a processing circuit DC, and a switch unit TX, to correspond to a number 2M of ejection units D[1] to D[2M] in a one-to-one correspondence.

A clock signal CL, a print signal SI, a latch signal LAT, a change signal CH, and a driving signal Com are supplied from the control mechanism 20 to the head driver DR.

As described above, the driving signal Com that is supplied to the head driver DR includes driving signals Com-A and Com-B. The driving signals Com-A and Com-B are signals having waveforms for driving the ejection units D.

The print signals SI are digital signals that determine the amounts of ink to be ejected from the ejection units D[1] to D[2M] as described above. The ejection/non-ejection of ink and the amounts of ink are designated with 2 bits of an upper bit b1 and a lower bit b2. Specifically, the print signal SI designates, for each ejection unit D, one of ejection of ink by an amount corresponding to a large dot, ejection of ink by an amount corresponding to a medium dot, ejection of ink by an amount corresponding to a small dot, and micro-vibration (see FIGS. 7A to 7C). If micro-vibration is designated, ink is not ejected.

The head driver DR supplies an individual driving signal Vin having a waveform designated with the print signal SI, to each ejection unit D.

A number 2M of shift registers SR from a 1st stage to a 2M-th stage successively transfer the print signal SI to the downstream stage in accordance with the clock signal CL. When the print signal SI is transferred to the 2M-th-stage shift register SR, that is, when a print signal SI[m] that determines the ejection amount of ink for an m-th-stage ejection unit D[m] included in the print signals SI is transferred to the m-th-stage shift register SR[m], each shift register SR[m] temporarily holds the transferred 2-bit print signal SI[m].

The number 2M of latch circuits LT each latch the print signal SI[m] for 2 bits, which are held in each of the number 2M of shift registers SR and which correspond to each stage, simultaneously at a timing at which the latch signal LAT rises.

An operation period in which the piezoelectric ink jet printer 1 executes print processing includes a plurality of unit periods Tu.

The control mechanism 20, to the head driver DR, supplies the print signal SI every unit period Tu, and the latch signal LAT so that the latch circuit LT latches the print signal SI. Also, the control mechanism 20 supplies the driving signal Com (the driving signals Com-A and Com-B) to the head driver DR every unit period Tu. Accordingly, the control mechanism 20 controls the operation of the head driver DR so that the ejection unit D executes one of ejection of ink by an amount corresponding to a large dot, ejection of ink by an amount corresponding to a medium dot, ejection of ink by an amount corresponding to a small dot, and micro-vibration.

In this embodiment, the control mechanism 20 divides the unit period Tu into a control period Ts1 and a control period Ts2 by the change signal CH. In this embodiment, it is assumed that the control periods Ts1 and Ts2 have equivalent lengths of time. In the following description, the control periods Ts1 and Ts2 are occasionally collectively referred to as control period Ts.

The processing circuit DC outputs a select signal SL[m] based on the print signal SI[m] latched by the latch circuit LT. In this embodiment, the select signal SL[m] includes a select signal SLa[m] for selecting the driving signal Com-A and a select signal SLb[m] for selecting the driving signal Com-B.

As shown in FIG. 5, the head driver DR includes a number 2M of switch units TX to correspond to the number 2M of ejection units D[1] to D[2M] in a one-to-one correspondence. Each switch unit TX includes a transmission gate TGa and a transmission gate TGb. The transmission gate TGa and the transmission gate TGb function as switches that switch between supply and non-supply of the driving signal Com to the piezoelectric element 37.

A transmission gate TGa[m] provided for an m-th-stage switch unit TX[m] is tuned ON when the select signal SLa[m] is at H level, and is turned OFF when the select signal SLa[m] is at L level. Also, a transmission gate TGb[m] provided for the m-th-stage switch unit TX[m] is tuned ON when the select signal SLb[m] is at H level, and is turned OFF when the select signal SLb[m] is at L level.

For example, when the print signal SI[m] indicates (1, 0) (see FIGS. 7A to 7C), the transmission gate TGa[m] is turned ON and the transmission gate TGb[m] is turned OFF in the control period Ts1, and the transmission gate TGa[m] is turned OFF and the transmission gate TGb[m] is turned ON in the control period Ts2.

As shown in FIG. 5, the driving signal Com-A is supplied to one end of the transmission gate TGa[m] provided in the head driver DR, and the driving signal Com-B is supplied to one end of the transmission gate TGb[m] provided in the head driver DR. Also, the other ends of the transmission gates TGa[m] and TGb[m] are electrically coupled to an m-th-stage output terminal OTN.

Also, in this embodiment, as shown in FIGS. 7A to 7C, in each control period Ts, the switch unit TX is controlled so that the transmission gates TGa[m] and TGb[m] are not simultaneously turned ON.

Figure 6:
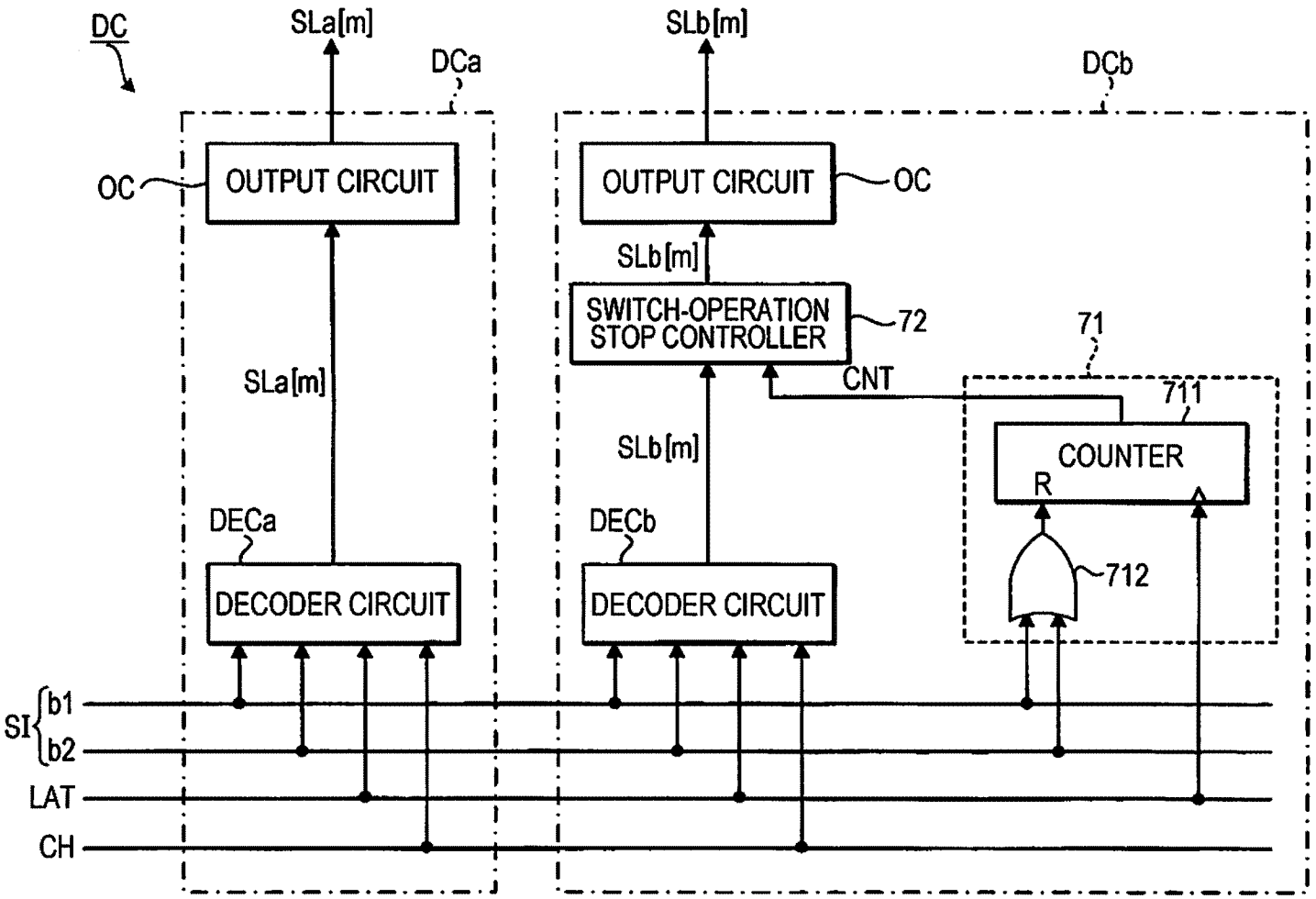
FIG. 6 is a block diagram showing an electric configuration of a processing circuit.

FIG. 6 is a block diagram of an m-th-stage processing circuit DC. As shown in the drawing, the processing circuit DC includes a first processor DCa that generates a select signal SLa[m], and a second processor DCb that generates a select signal SLb[m]. The first processor DCa includes a decoder circuit DECa and an output circuit OC. The output circuit OC shifts the level of the output signal of the decoder circuit DECa that operates with low voltage, and outputs the select signal SLa[m] to the switch unit TX that operates with high voltage. For example, the decoder circuit DECa operates with 3.3 V, and the switch unit TX operates with 40 V.

FIG. 7A is an explanatory view showing decoding contents of the m-th-stage first processor DCa. As shown in the drawing, the m-th-stage first processor DCa outputs the select signal SLa[m] in each of the control periods Ts1 and Ts2 of each unit period Tu. For example, when the print signal SI[m] supplied in the unit period Tu is (b1, b2) (1, 0), the m-th-stage first processor DCa sets the select signal SLa[m] to H level in the control period Ts1, and sets the select signal SLa[m] to L level in the control period Ts2.

As shown in FIG. 7A, when (b1, b2)=(0, 0) which is the print signal SI[m] for designating micro-vibration is decoded, the select signals SLa[m] in the control periods Ts1 and Ts2 are set to L level. Thus, when the print signal SI[m] is (b1, b2)=(0, 0), the driving signal Com-A is not selected.

As shown in FIG. 6, the second processor DCb includes a decoder circuit DECb, a history-information memory 71, a switch-operation stop controller 72, and an output circuit OC. FIG. 7B is an explanatory view showing decoding contents of an m-th-stage decoder circuit DECb. As shown in the drawing, the decoder circuit DECb outputs the select signal SLb[m] in each of the control periods Ts1 and Ts2 of each unit period Tu. For example, when the print signal SI[m] supplied in the unit period Tu is (b1, b2)=(0, 0), the m-th-stage second processor DCb sets the select signal SLb[m] to H level in the control period Ts1, and sets the select signal SLb[m] to L level in the control period Ts2.

The history-information memory 71 holds history information indicating history of ON/OFF of the transmission gates TGa and TGb included in the switch unit TX. More specifically, the history-information memory 71 holds the number of times that (b1, b2)=(0, 0) with which the print signal SI[m] designates micro-vibration is successively made.

The history-information memory 71 includes a counter 711 and an OR circuit 712. The counter 711 counts the rise of the latch signal LAT. When the logic level of a reset terminal R becomes H level, the count value K is reset. The counter 711 outputs a detection signal CNT that causes the level to be H level if the count value K is a predetermined value or larger, and that causes the level to be L level if the count value K is smaller than the predetermined value.

In this case, the OR circuit 712 resets the count value K of the counter 711 if at least one of the bit b1 and the bit b2 of the print signal SIM is "1." As shown in FIGS. 7A and 7B, ejection of ink is designated if at least one of the bit b1 and the bit b2 of the print signal SI[m] is "1." That is, the counter 711 increments the count value K when the print signal SI[m] is (b1, b2)=(0, 0) and micro-vibration is designated, and rests the count value K when ejection of one of large-dot ink, medium-dot ink, and small-dot ink is designated with the print signal SI[m]. In other words, the counter 711 holds the count value K obtained by counting the number of supply times of the micro-vibration waveform that is successively supplied to the piezoelectric element 37, and resets the count value K when an ejection waveform for ejection of ink is supplied to the piezoelectric element 37. The count value K corresponds to the history information indicating history of ON/OFF of the transmission gates TGa and TGb.

The switch-operation stop controller 72 outputs the select signal SLb[m] that becomes L level so as to turn OFF the transmission gate TGb, when the detection signal CNT is active, that is, when the detection signal CNT is at H level in this example. Also, the switch-operation stop controller 72 outputs the output signal of the decoder circuit DECb as the select signal SLb[m] without being changed when the detection signal CNT is at H level. The level of the select signal SLb[m] is shifted by the output circuit OC, and output to the transmission gate TGb.

Consequently, if the number of successive supply times of micro-vibration is smaller than a predetermined value, the decoding contents of the second processor DCb are the same as those of the decoder circuit DECb shown in FIG. 7B, and if the number of successive supply times of micro-vibration is the predetermined value or larger, the decoding contents of the second processor DCb are those shown in FIG. 7C. That is, when the print signal SI[m] is (0, 0), the select signal SLb[m] in the control period Ts1 is at L level.

If micro-vibration is successively made the predetermined number of times or more and the count value K is a predetermined number or larger, the switch-operation stop controller 72 stops the switch operation of the transmission gate TGb, and holds the logic level of the select signal SLb[m] at L level to stop the transmission gate TGb while the transmission gate TGb is OFF.

Consequently, the level of the large-amplitude select signal SLb[m] output from the output circuit OC is held constant. Large current flows to the output circuit OC when the logic level of the select signal SLb[m] is changed from L level to H level, and when the logic level of the select signal SLb[m] is changed from H level to L level. Hence, when the switch-operation stop controller 72 stops the switch operation, the electric power consumed by the output circuit OC is decreased as compared with the case where the switch operation is executed. Also, since the driving signal Com-B is not supplied to the piezoelectric element 37 via the transmission gate TGb, the electric power consumed by the transmission gate TGb is decreased. Thus, generation of heat by the output circuit OC and the transmission gate TGb can be suppressed, and generation of heat by the head driver DR can be suppressed.

1-5. Driving Signal

Figure 8:
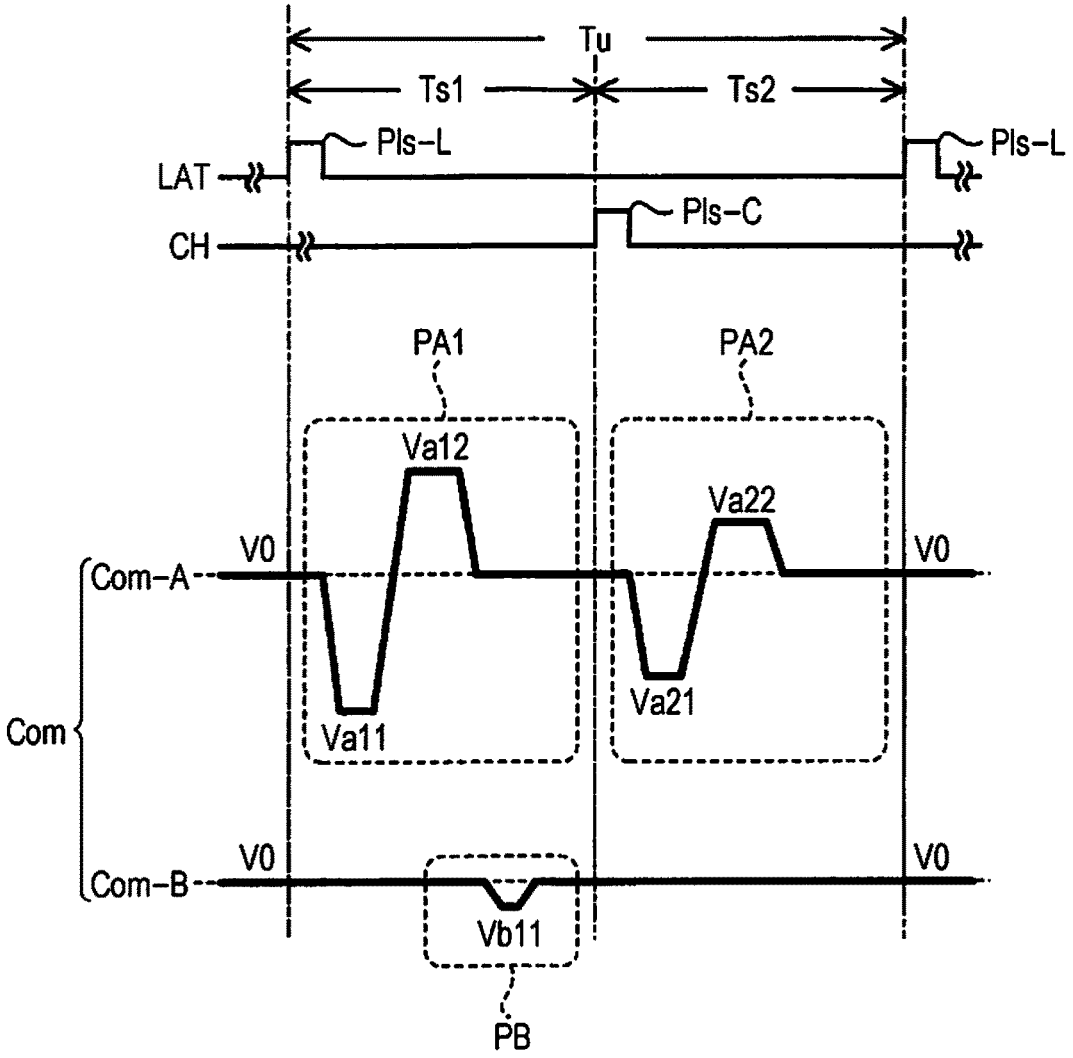
FIG. 8 is a timing chart for explaining an operation of a head driver.

FIG. 8 is a timing chart for explaining various signals supplied by the control mechanism 20 to the head driver DR, and an operation of the head driver DR in each unit period Tu. Note that FIG. 8 shows the case of 2M=4 for the convenience of illustration.

As shown in FIG. 8, the unit period Tu is determined (divided) by a pulse Pls-L included in the latch signal LAT. The control periods Ts1 and Ts2 are determined (divided) by the pulse Pls-L and a pulse Pls-C included in the change signal CH.

The control mechanism 20 supplies the print signal SI to the head driver DR in synchronization with the clock signal CL before each unit period Tu is started. Then, the shift register SR of the head driver DR successively transfers the supplied print signal SI to the downstream stage in accordance with the clock signal CL.

As shown in FIG. 8, the driving signal Com-A of each unit period Tu has an ejection waveform PA1 provided in the control period Ts1, and an ejection waveform PA2 provided in the control period Ts2.

The ejection waveform PA1 is a waveform that causes an ejection unit D[m] to eject a medium amount of ink corresponding to a medium dot when an individual driving signal Vin[m] having the ejection waveform PA1 is supplied to the ejection unit D[m].

The ejection waveform PA2 is a waveform that causes the ejection unit D[m] to eject a small amount of ink corresponding to a small dot when an individual driving signal Vin[m] having the ejection waveform PA2 is supplied to the ejection unit D[m].

For example, the potential difference between the lowest potential (in this example, potential Va11) and the highest potential (in this example, potential Va12) of the ejection waveform PA1 is larger than the potential difference between the lowest potential (in this example, potential Va21) and the highest potential (in this example, potential Va22) of the ejection waveform PA2.

As shown in FIG. 8, the driving signal Com-B in each unit period Tu has a micro-vibration waveform PB. The micro-vibration waveform PB is a waveform that causes the ejection unit D[m] not to eject ink when an individual driving signal Vin[m] having the micro-vibration waveform PB is supplied to the ejection unit D[m]. That is, the micro-vibration waveform PB is a waveform for applying micro-vibration to ink in the ejection unit D and preventing an increase in viscosity of the ink. For example, the potential difference between the lowest potential (in this example, potential Vb11) and the highest potential (in this example, reference potential V0) of the micro-vibration waveform PB is smaller than the potential difference between the lowest potential and the highest potential of the ejection waveform PA2. That is, in this embodiment, the amplitude of the driving signal Com-A is larger than the amplitude of the driving signal Com-B.

1-6. Individual Driving Signal

Figure 9:
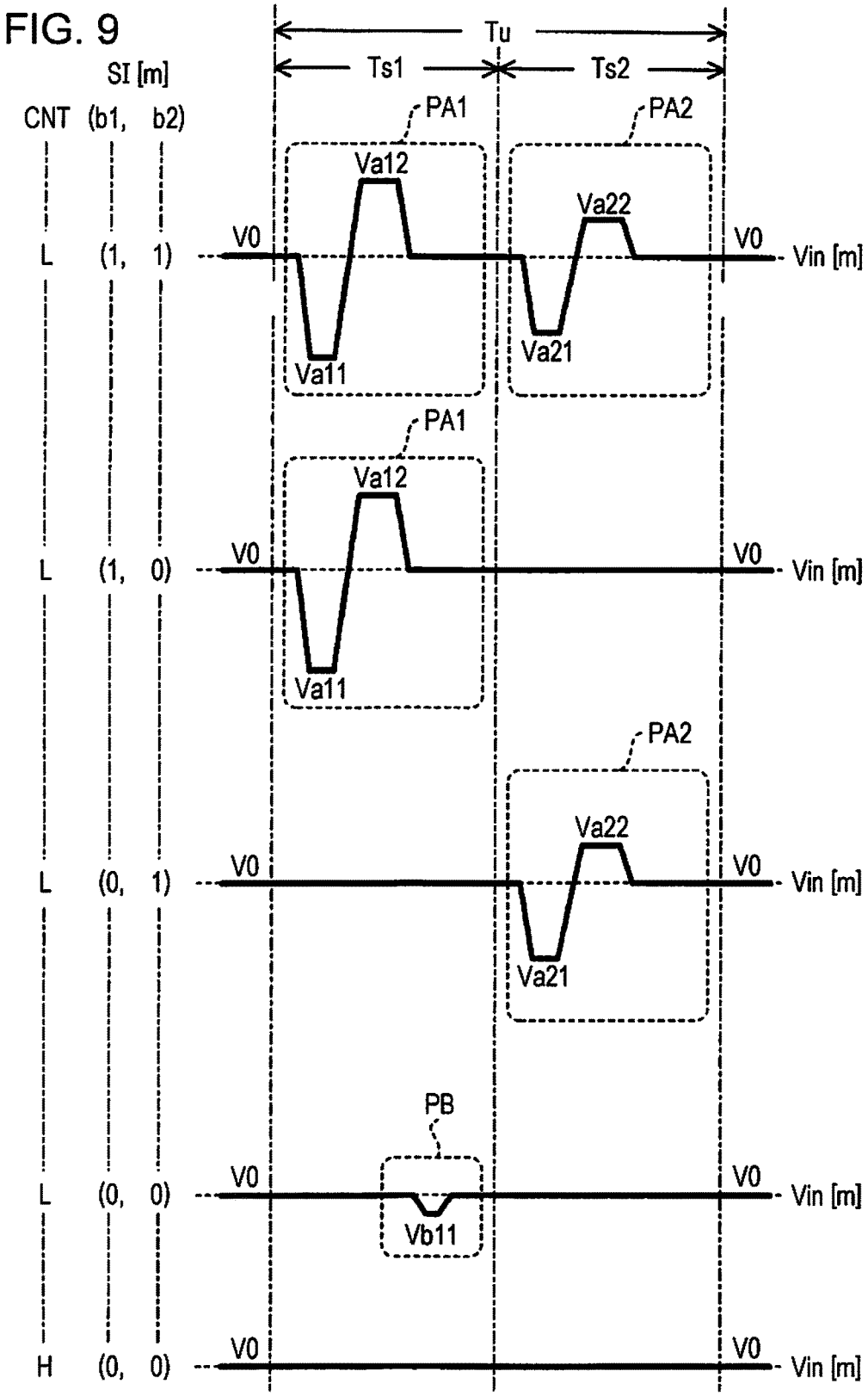
FIG. 9 is a waveform diagram for explaining individual driving signals.

Next, an individual driving signal Vin[m] that is output by the head driver DR in a unit period Tu is described with reference to FIG. 9.

When the print signal SI[m] that is supplied to the head driver DR in the unit period Tu indicates (1, 1) and the detection signal CNT is at L level, the switch unit TX[m] selects the driving signal Com-A in the control period Ts1 and outputs the individual driving signal Vin[m] having the ejection waveform PA1, and selects the driving signal Com-A in the control period Ts2 and outputs the individual driving signal Vin[m] having the ejection waveform PA2. Hence, in this case, as shown in FIG. 9, the individual driving signal Vin[m] supplied to the ejection unit D[m] in the unit period Tu includes the ejection waveform PA1 and the ejection waveform PA2. Consequently, the ejection unit D[m] ejects a medium amount of ink based on the ejection waveform PA1 and a small amount of ink based on the ejection waveform PA2 in the unit period Tu, and a large dot is formed on a medium 12 with the ink ejected two times.

When the print signal SI[m] that is supplied to the head driver DR in the unit period Tu indicates (1, 0) and the detection signal CNT is at L level, the switch unit TX[m] selects the driving signal Com-A in the control period Ts1 and outputs the individual driving signal Vin[m] having the ejection waveform PA1, and does not select either of the driving signal Com-A and the driving signal Com-B in the control period Ts2. Hence, in this case, as shown in FIG. 9, the individual driving signal Vin[m] supplied to the ejection unit D[m] in the unit period Tu includes the ejection waveform PA1. Consequently, the ejection unit D[m] ejects a medium amount of ink based on the ejection waveform PA1 in the unit period Tu, and forms a medium dot on the medium 12.

When the print signal SI[m] that is supplied to the head driver DR in the unit period Tu indicates (0, 1) and the detection signal CNT is at L level, the switch unit TX[m] does not select either of the driving signal Com-A and the driving signal Com-B in the control period Ts1 and outputs the individual driving signal Vin[m], and selects the driving signal Com-A in the control period Ts2 and outputs the individual driving signal Vin[m] having the ejection waveform PA2. Hence, in this case, as shown in FIG. 9, the individual driving signal Vin[m] supplied to the ejection unit D[m] in the unit period Tu includes the ejection waveform PA2. Consequently, the ejection unit D[m] ejects a small amount of ink based on the ejection waveform PA2 in the unit period Tu, and forms a small dot on the medium 12.

When the print signal SI[m] that is supplied to the head driver DR in the unit period Tu indicates (0, 0) and the detection signal CNT is at L level, the switch unit TX[m] selects the driving signal Com-B in the control period Ts1 and outputs the individual driving signal Vin[m] having the micro-vibration waveform PB, and does not select either of the driving signal Com-A and the driving signal Com-B in the control period Ts2 and outputs the individual driving signal Vin[m]. Hence, in this case, as shown in FIG. 9, the individual driving signal Vin[m] that is supplied to the ejection unit D[m] in the unit period Tu includes the micro-vibration waveform PB.

A case where the detection signal CNT is at H level and active is described next. The detection signal CNT is at H level if print signal SIM[m]=(0, 0) is successively made a predetermined number of times or more. Hence, when the print signal SI[m] is (1, 1), (1, 0), or (0, 1), the detection signal CNT is constantly at L level.

When the print signal SI[m] that is supplied to the head driver DR in the unit period Tu indicates (0, 0) and the detection signal CNT is at H level, the switch unit TX[m] does not select either of the driving signal Com-A and the driving signal Com-B in the control periods Ts1 and Ts2, and outputs the individual driving signal Vin[m]. Hence, in this case, as shown in FIG. 9, the individual driving signal Vin[m] that is supplied to the ejection unit D[m] in the unit period Tu does not include either of the ejection waveform PA1, the ejection waveform PA2, and the micro-vibration waveform PB.

As described above, with this embodiment, since the switch-operation stop controller 72 can stop the switch operation in accordance with the history of ON/OFF of the transmission gates TGa and TGb, a temperature rise of the piezoelectric print head HU can be decreased, and current consumption of the output circuit OC can be decreased.

Also, since the count value K of the counter 711 is reset when an ejection waveform is supplied to the piezoelectric element 37, heat is released by ejection of ink, and then micro-vibration is executed until the successive supply of the micro-vibration waveform PB to the piezoelectric element 37 becomes the predetermined number of times or more, and the increase in viscosity of ink can be suppressed.

The increase in viscosity of liquid and the temperature rise of liquid have a trade-off relationship. The two trade-off elements can be well balanced by adjusting the predetermined number that serves as a reference for determining whether the switch operation is stopped or not.

2. Modifications

The embodiments exemplarily described above may be modified in various ways. Specific modification aspects are exemplarily described below. Two or more aspects desirably selected from the examples may be properly combined unless the examples are inconsistent with each other.

First Modification

In the above-described embodiment, the counter 711 counts the number of times the micro-vibration waveform PB is successively supplied to the piezoelectric element 37, and the switch-operation stop controller 72 stops the switch operation for switching ON/OFF of the transmission gate TGb; however, the invention is not limited thereto. That is, the switch operation may be stopped in accordance with the history of ON or OFF of at least one of the transmission gates TGb and TGa. For example, when the ejection waveform for a large dot is selected for a long term, heat is sufficiently released. In such a case, the predetermined number that serves as a reference for stopping the switch operation may be increased.

Second Modification

The piezoelectric ink jet printer 1 exemplified in each of the above-described embodiment and modification may be applied to, in addition to an apparatus dedicated to printing, various apparatuses, such as a facsimile apparatus and a copy machine. The purpose of use of the piezoelectric ink jet printer according to the invention is not limited to printing. For example, a piezoelectric ink jet printer that ejects liquid of a color material is used as a manufacturing apparatus that forms a color filter for a liquid crystal display device. Also, a piezoelectric ink jet printer that ejects a solution of an electrically conductive material is used for a manufacturing apparatus that forms wiring and electrodes for a wiring substrate.

What is claimed is:

1. A piezoelectric print head, comprising:

a piezoelectric element;

a nozzle that ejects liquid when the piezoelectric element is driven;

a switch that switches between supply and non-supply of a driving signal for driving the piezoelectric element to the piezoelectric element;

a history-information memory that holds history information indicating history of ON or OFF of the switch; and a switch-operation stop controller that stops a switch operation that causes the switch to be turned OFF from ON or to be turned ON from OFF, in accordance with the history information.

2. The piezoelectric print head according to claim 1, wherein the liquid has properties that are deteriorated at a temperature lower than 100° C.

3. A piezoelectric ink jet printer, comprising:

the piezoelectric print head according to claim 2, wherein the liquid is ink.

4. The piezoelectric print head according to claim 1, wherein 400 or more nozzles including the nozzle are arranged in a row with a density of 300 or more nozzles per inch, and wherein the piezoelectric element, the switch, the history-information memory, and the switch-operation stop controller are provided for each of the 400 or more nozzles.

5. A piezoelectric ink jet printer, comprising:

the piezoelectric print head according to claim 4, wherein the liquid is ink.

6. The piezoelectric print head according to claim 1, wherein the driving signal includes a micro-vibration waveform that causes the liquid not to be ejected when the micro-vibration waveform is supplied to the piezoelectric element, wherein the history-information memory includes a counter that counts a number of supply times of the micro-vibration waveform that is successively supplied to the piezoelectric element through ON or OFF of the switch, and wherein the history information is a count value of the counter.

7. The piezoelectric print head according to claim 6, wherein the driving signal includes an ejection waveform that causes the liquid to be ejected when the ejection waveform is supplied to the piezoelectric element, and wherein, when the ejection waveform is supplied to the piezoelectric element through ON or OFF of the switch, the count value of the counter is reset.

8. A piezoelectric ink jet printer, comprising:

the piezoelectric print head according to claim 7, wherein the liquid is ink.

9. The piezoelectric print head according to claim 6, wherein the switch-operation stop controller stops the switch while the switch is OFF if the count value is a predetermined number or larger.

10. A piezoelectric ink jet printer, comprising:

the piezoelectric print head according to claim 9, wherein the liquid is ink.

11. A piezoelectric ink jet printer, comprising:

the piezoelectric print head according to claim 6, wherein the liquid is ink.

12. The piezoelectric print head according to claim 1, further comprising:

a circuit board provided with an output circuit that outputs a select signal that causes the switch to be turned ON or OFF, the switch, the history-information memory, and the switch-operation stop controller; and a pressure chamber filled with liquid and having an internal pressure that increases and decreases in accordance with driving of the piezoelectric element, wherein the piezoelectric element is provided in a sealed space that is defined by a plurality of members including the circuit board.

13. A piezoelectric ink jet printer, comprising:
the piezoelectric print head according to claim 12, wherein the liquid is ink.

14. A piezoelectric ink jet printer, comprising:
the piezoelectric print head according to claim 1, wherein the liquid is ink.

* * * * *